United States Patent [19]

Smith, Jr.

[11] 4,022,450

[45] May 10, 1977

[54] LINE TENSIONING DEVICE

[76] Inventor: Barry E. Smith, Jr., 6623 Sheridan St., Hollywood, Fla. 33024

[22] Filed: Apr. 14, 1976

[21] Appl. No.: 677,029

[52] U.S. Cl. ..... 267/73; 114/213; 114/230

[51] Int. Cl.[2] ..... B63B 21/00; F16F 1/12

[58] Field of Search ..... 114/230, 235 A, 235 R, 114/213, 215, 216; 267/69, 73, 74; 24/129 A; 38/94, 104; 222/530, 529; 137/355.23, 355.24

[56] References Cited

UNITED STATES PATENTS

| | | | |
|---|---|---|---|
| 1,647,790 | 11/1927 | Fulton | 267/74 |
| 1,765,179 | 6/1930 | Roders | 267/69 |
| 2,569,783 | 10/1951 | Smith | 114/230 |
| 2,640,534 | 6/1953 | Coffing | 114/230 |
| 2,948,306 | 8/1960 | Kuraeff | 222/178 X |
| 3,195,498 | 7/1965 | Johns | 114/230 |

FOREIGN PATENTS OR APPLICATIONS

| | | | |
|---|---|---|---|
| 707,639 | 4/1965 | Canada | 267/73 |
| 18,713 | 9/1928 | Netherlands | 267/73 |
| 1,125,462 | 8/1968 | United Kingdom | 222/530 |

*Primary Examiner*—Trygve M. Blix
*Assistant Examiner*—Gregory W. O'Connor
*Attorney, Agent, or Firm*—Jack D. Slobod

[57] ABSTRACT

A line tensioning device for maintaining a resilient sinuous bend in an elongated flexible line includes a pair of opposed semi-circular sections forming a rigid tube clamped coaxially about a portion of the length of the line and a pair of parallel elongated springs directed respectively between the opposite ends of the member and points along the line.

4 Claims, 4 Drawing Figures

LINE TENSIONING DEVICE

FIELD OF THE INVENTION

The present invention relates generally to resilient devices for maintaining a flexible line taut while allowing a predetermined amount of resilient elongation in the effective length of the line. In its particular aspects the present invention relates to a device for maintaining a resilient sinuous bend in a flexible line.

BACKGROUND OF THE INVENTION

In mooring a boat to a pier or dock it is necessary to maintain a rope taut while allowing freedom in the mooring arrangement to allow the boat to move vertically with the tide. While numerous mooring arrangements are known in the prior art, these arrangements require complicated and difficult to use auxiliary devices. U.S. Pat. Nos. 3,195,498 and 3,406,651 may be considered generally illustrative of prior art boat mooring arrangements.

Similar problems also arise in conjunction with guy lines used for supporting structures where a certain amount of freedom of elongation of the lines may be desirable in order to better sustain wind and ice loads.

OBJECTS OF THE INVENTION

It is an object of the present invention to provide a simple device for maintaining a resilient sinous bend in an elongated flexible line for tensioning the line while allowing freedom for the line to elongate a predetermined amount.

It is a further object of the present invention to provide a simple and effective resilient line tensioning device for acting in parallel with a line.

SUMMARY OF THE INVENTION

Briefly the aforementioned and other objects of the present invention are satisfied by providing a device for maintaining a resilient sinuous bend in an elongated flexible line which includes an elongated rigid member secured along a portion of the length of the line and springs radiating respectively from first and second ends of the member to points on the line spaced away respectively from the second and first ends of the member.

For ease of installation, the rigid member is formed by separate opposed semi-circular members which together form a tube about the line. The members are clamped in place by suitable hose clamps. Other hose clamps are installed at the aforementioned points on the line to enable attachment of the springs thereto.

Other objects, features and advantages of the present invention will become apparent upon perusal of the following detailed description of the preferred embodiment thereof when taken in conjunction with the appended drawing wherein:

DETAILED DESCRIPTION

Figure 1:
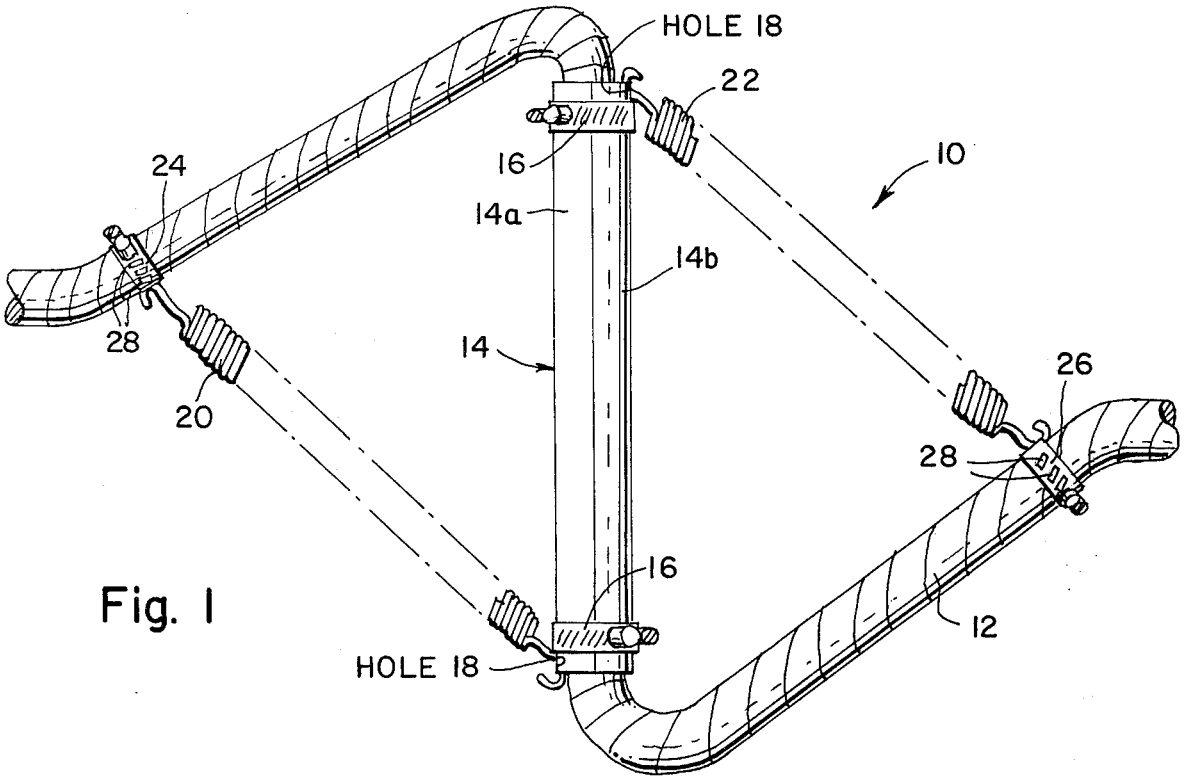
FIG. 1 is a plan view of the line tensioning device of the present invention under conditions of only a relatively small amount of line tension.

Referring first to FIG. 1 of the drawing, the device 10 of the present invention is illustrated for resiliently maintaining a sinuous bend in a flexible line 12, as of rope. Device 10 includes a rigid tube 14 clamped coaxially about a portion of the length of line 12. The tube 14 is preferably formed by two opposed stainless steel semi-circular sections **14*a* and 14*b* which are clamped in place by suitable clamps such as stainless steel hose clamps 16 encircling tube 14. Oppositely facing holes 18 are provided in the walls of the member 14*a* and 14*b* at opposite ends of tube 14. A pair of elongated, preferably chrome-plated, helical springs 20 and 22 are hooked at one end through the respective holes 18. Other stainless steel hose clamps 24, 26 of the worm driven type are secured about the line 12 at points spaced away from opposite ends of tube 14. The other ends of springs 20, 22 are hooked through one of the usual apertures 28 in the respective clamps 24, 26. The arrangement of springs 20, 22 is that each spring radiates from one end of the tube 14 to a different point along the rope spaced away from the opposite end of tube 14**.

The springs 20, 22 are substantially identical and the clamps 24, 26 are positioned on line 12 at equal distances along the line from the opposite ends of tube 14. Thus, when the opposite ends of line 12 are pulled to establish a moderate tension the springs 20, 22 are stretched slightly and are positioned parallel to each other and at a 45° angle with respect to tube 14. Also, tube 14 is directed perpendicular to the taut portions of line 12. It will be appreciated that this slight amount of stretching of springs 20, 22 can keep line 12 taut when the opposite ends of the line are secured to a pair of objects to be connected together.

Figure 2:
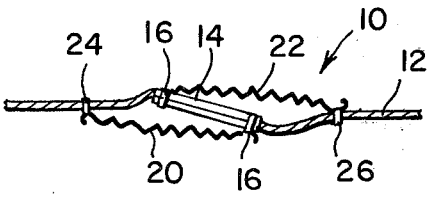
FIG. 2 is a plan view similar to FIG. 1, but with the parts of the line tensioning device positioned under conditions of increased line tension.

As the tension in line 12 is increased, as shown in FIG. 2, the springs 20, 22 maintain their parallel relationship, however the springs and tube 14 tend to align themselves with the taut portions of line 12. Thus, it will be appreciated that the device 10 has the capability of increasing the length of line 12 by a predetermined amount equal generally to somewhat more than the length of tube 14.

Figure 3:
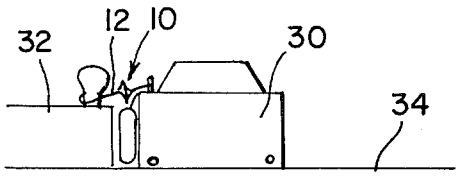
FIGS. 3 and 4 are similar elevational views of a boat mooring arrangement utilizing the line tensioning device, with the boat disposed respectively as in high and low tide.
Figure 4:
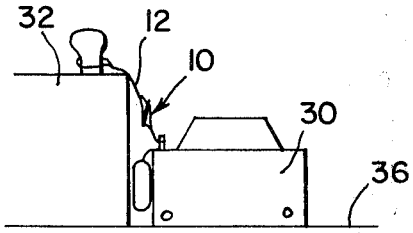

With reference to FIGS. 3 and 4, the line 12, with device 10 thereon, is illustrated directed between a boat 30 and a pier or dock 32. In FIG. 3, the water level 34 is at high tide while the water level 36 in FIG. 4 is at low tide. It will be appreciated that by mooring boat 30 at high tide with device 10 tensioned as in FIG. 1 then there is freedom for boat 30 to move downward at low tide by the device 10 flexing as in FIG. 2.

Having described the preferred embodiment of the present invention, it will be appreciated that numerous modifications, additions and omissions in the details thereof are possible within the intended spirit and scope of the invention claimed herein.

What is claimed is:

1. A device for maintaining a resilient sinuous bend in an elongated flexible line comprising: an elongated rigid member secured along a portion of said line throughout the length of said member; said member having first and second opposite ends; a first elongated spring secured at one end of said first spring to the first end of said member and secured at the other end of said first spring to a point on said line spaced away from said second end; and a second elongated spring secured at one end of said second spring to the second end of said member and secured at the other end of said second spring to a point on said line spaced away from said first end.

2. The device of claim 1 wherein said rigid member comprises a tubular member disposed generally coaxially about said line.

3. The device of claim 2 wherein said tubular member is formed of two opposed semi-circular half sections.

4. A device for maintaining a resilient sinuous bend in an elongated flexible line comprising: an elongated rigid member secured along a portion of said line, said member having first and second opposite ends; a first elongated spring secured at one end of said first spring to the first end of said member and secured at the other end of said first end of said member and secured at the other end of said first spring to a point on said line spaced away from said second end; a second elongated spring secured at one end of said second spring to the second end of said member and secured at the other end of said second spring to a point on said line spaced away from said first end, wherein said rigid member comprises a tubular member disposed generally coaxially about said line, said tubular member being formed of two opposed semi-circular half sections.

* * * * *